US006661391B2

(12) United States Patent
Ohara et al.

(10) Patent No.: US 6,661,391 B2
(45) Date of Patent: Dec. 9, 2003

(54) ANTENNA AND RADIO DEVICE COMPRISING THE SAME

(75) Inventors: Masahiro Ohara, Osaka (JP); Toyoshi Fukumura, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/048,062

(22) PCT Filed: Jun. 8, 2001

(86) PCT No.: PCT/JP01/04868

§ 371 (c)(1),
(2), (4) Date: May 1, 2002

(87) PCT Pub. No.: WO01/95430

PCT Pub. Date: Dec. 13, 2001

(65) Prior Publication Data

US 2002/0149537 A1 Oct. 17, 2002

(30) Foreign Application Priority Data

Jun. 9, 2000 (JP) ..... 2000-173136

(51) Int. Cl.[7] ..... H01Q 1/36
(52) U.S. Cl. ..... 343/895; 343/702; 343/872
(58) Field of Search ..... 343/895, 872, 343/702, 853; 29/600

(56) References Cited

U.S. PATENT DOCUMENTS

| | | | | |
|---|---|---|---|---|
| 3,633,210 A | * | 1/1972 | Westerman et al. | 343/895 |
| 5,374,937 A | | 12/1994 | Tsunekawa et al. | 343/702 |
| 5,995,065 A | | 11/1999 | Kitchener et al. | 343/895 |
| 6,181,297 B1 | * | 1/2001 | Leisten | 343/895 |
| 6,232,925 B1 | * | 5/2001 | Fujikawa | 343/702 |
| 6,369,777 B1 | * | 4/2002 | Ohara et al. | 343/895 |
| 6,388,625 B1 | * | 5/2002 | Fukushima et al. | 343/702 |
| 6,424,302 B1 | * | 7/2002 | Wu | 343/702 |
| 6,433,755 B1 | * | 8/2002 | Kuramoto | 343/895 |
| 6,480,173 B1 | * | 11/2002 | Marino | 343/895 |
| 6,525,692 B2 | * | 2/2003 | Kim et al. | 343/702 |

FOREIGN PATENT DOCUMENTS

| | | |
|---|---|---|
| EP | 0777293 | 6/1997 |
| EP | 0 833 455 | 4/1998 |
| EP | 0 893 841 | 1/1999 |
| EP | 0 984 510 | 3/2000 |
| EP | 0 987 788 | 3/2000 |
| EP | 0997970 | 5/2000 |
| EP | 1 122 811 | 8/2001 |
| JP | 5-76111 | 10/1993 |
| JP | 10-93315 | 4/1998 |

* cited by examiner

*Primary Examiner*—Tan Ho
(74) *Attorney, Agent, or Firm*—Wenderoth, Lind & Ponack, L.L.P.

(57) ABSTRACT

An antenna is capable of transmitting/receiving waves in multi-ranged frequency bands, and providing high antenna gain, reliability and productivity. A radio communication apparatus uses the antenna. A feed portion is electrically connected with an antenna element portion at one end, and with radio-frequency circuitry of the apparatus at another end. A dielectric material core rod mechanically supports the antenna element portion. A dielectric material radome partially covers the antenna element and feed portion. The antenna element portion is formed from an approximately helical-shaped portion and an approximately meander-shaped portion, both of which are made from a thin-belt-shaped conductive plate and concentrically arranged on the core rod. Properly adjusting of the approximately helical-shaped and the approximately meander-shaped portions can provide impedance characteristics optimal for multi-ranged frequency bands.

34 Claims, 14 Drawing Sheets

ANTENNA AND RADIO DEVICE COMPRISING THE SAME

FIELD OF THE INVENTION

The present invention relates to fixed an antenna to a radio communication apparatus for mobile communications, and a radio communication apparatus using the same antenna.

BACKGROUND OF THE INVENTION

In recent years, as a demand for mobile communications has drastically increased, radio communication apparatuses have been developed in a wide variety of forms. An example of this diversity is a radio communication apparatus capable of transmitting/receiving radio waves in multi-ranged frequency bands so that a single radio communication apparatus can handle as much information as possible. Such an apparatus includes an antenna having desirable impedance characteristics over multi-ranged frequency bands.

A mobile phone system is a typical example of mobile communications, which is now widely used all over the world. A frequency bandwidth for the mobile phone system varies by region: Personal Digital Cellular 800 (PDC 800) in Japan uses a frequency in a range of from 810 to 960 MHz. On the other hand, in the West, a range of from 890 to 960 MHz is used for Group Special Mobile Community (GSM), a range of from 1,710 to 1,880 MHz for Personal Communication Network (PCN), and a range of from 1,850 to 1,990 MHz for Personal Communication System (PCS). Generally, for a mobile phone corresponding to each of the multi-ranged frequency bands, a helical antenna element formed of helically wound conductive wire is widely used.

FIG. 12 is a general sectional view of a prior-art antenna for two frequency bands—for a range of from 890 to 960 MHz of GSM and for a range of from 1,710 to 1,880 MHz of PCN. FIGS. 13 and 14 are graphs that represent frequency characteristics of voltage standing wave ratio (VSWR) showing impedance characteristics.

In antenna 8 shown in FIG. 12, phosphor bronze wire-made antenna element 3 contains linear portion 1 at an inside of helical portion 2, with a top end of linear portion 1 and helical portion 2 being connected to form one piece. Feed metal fitting 6 contains, at its top, recess portion 4 to which antenna element 3 is fixed, and at its bottom, mounting screw portion 5 by which fitting 6 is screwed into a radio communication apparatus. Dielectric resin material-made radome 7 partially covers antenna element 3 and feed metal fitting 6. Fitting 6 is attached to a housing of a mobile phone to establish electric connections with radio-frequency circuitry of the mobile phone, so that antenna 8 can work for two frequency bands mentioned above.

In antenna 8 having the structure above, an electrical length totally gained from linear portion 1 and helical portion 2 of antenna element 3 is adjusted to about $\lambda/2$ in a frequency band for PCN, and is adjusted to about $\lambda/4$ in a frequency band for GSM. Thus, an electrical coupling between linear portion 1 and helical portion 2 of antenna element 3 allows impedance characteristics of antenna element 3 to be optimum in each frequency band.

In prior art antenna 8, the impedance characteristics of antenna element 3 are required by which VSWR is to be at most 3 in each frequency band. However, it has been difficult for this conventional structure—i.e. an antenna element that is helically wound from one end of a straightened phosphor bronze wire—to satisfy this requirement. Suppose that an electrical length of antenna element 3 is adjusted to about $\lambda/2$ in the frequency band for PCN. As shown in FIG. 13, in the frequency band for PCN—between ▼3 and ▼4—impedance characteristics with VSWR kept below 3 can be realized with help of an electrical coupling between liner portion 1 and helical portion 2. On the other hand, in the frequency band for GSM—between ▼1 and ▼2—a range with VSWR maintained below 3 becomes narrower. Now, to eliminate this inconvenience, suppose that the frequency band for GSM (between ▼1 and ▼2) is broadened by changing a diameter or pitch of helical portion 2 and readjusting an electrical length. This adjustment is no good for the PCN band—it changes an electrical length of antenna element 3 for the frequency band for PCN and an electrical coupling between linear portion 1 and helical portion 2, so that VSWR in the frequency band for PCN (between ▼3 and ▼4) will be undesirably increased to be more than 4. Thus, there has been a problem with structure of the prior art antenna in that transmitting/receiving in either one of the frequency bands has been sacrificed for transmitting/receiving in the other of the frequency bands.

As another drawback, deformation or variations in diameter or pitch of helical portion 2 occurring during a manufacturing process of antenna element 3 can cause variations in impedance characteristics. For these variations, it has been difficult to get desired impedance characteristics. Providing a complicated impedance-matching circuit between an antenna and radio-frequency circuitry may be a measure for suppressing degradation of impedance characteristics due to the variations. However, this is apparently an obstacle to lower prices of mobile phones.

SUMMARY OF THE INVENTION

The present invention addresses the problems above. It is therefore an object of the present invention to provide a reliable antenna with high productivity, which is capable of: having an easy adjustment of an electrical length of an antenna element; obtaining good impedance characteristics in desired multi-ranged frequency bands by a single antenna element; and eliminating impedance matching circuitry to minimize variations in impedance characteristics. At the same time, it is another object of the present invention to realize a cost-reduced radio communication apparatus using the antenna.

To achieve the aforementioned objects, the antenna of the present invention includes: an antenna element portion for transmitting/receiving waves in multi-ranged frequency bands; a feed portion for establishing electrical connections between the antenna element portion and radio-frequency circuitry of a radio communication apparatus; a dielectric material core rod mechanically supporting the antenna element portion; and a dielectric material radome partially covering the antenna element portion and the feed portion. The antenna element portion comprises an approximately helical-shaped portion and an approximately meander-shaped portion that are formed concentrically with the core rod.

The antenna of the present invention may be variously embodied as follows.

1) The dielectric material forming the core rod has a relative dielectric constant different from that of the dielectric material forming the radome.

2) A half-round and thin belt-shaped first conductor has a diameter generally equal to that of the core rod. A plurality of first conductors are disposed in parallel from a position close to an end of the core rod in an axial direction, at predetermined spaced intervals, on a front-round surface and rear-round surface of the core rod. Rows of the conductors are placed in a staggered arrangement between the front-round surface and the rear-round surface of the rod. A short and thin belt-shaped conductive plate joins adjacent ends of the first conductors, forming an approximately helical-shaped portion. A plurality of thin belt-shaped second conductors are placed in parallel on the core rod. As in the case of the first conductor, a short and thin belt-shaped conductive plate joins adjacent ends of the second conductors, forming an approximately meander-shaped portion. The approximately meander-shaped portion is disposed close to the approximately helical-shaped portion.

3) The antenna element portion may be formed from a die cutting-processed thin and conductive metal-plate.

4) The antenna element portion may be formed from a press-processed conductive metal-wire made of alloys of copper, or other metals, provided by an electrolytic plating process.

5) The antenna element portion may be formed by subjecting a thin conductive plate to an etching process to form a predetermined pattern, and then press-processing the pattern.

6) The antenna element portion may be formed from a press-processed flexible wiring board having a predetermined pattern formed thereon.

7) The antenna element portion may be formed by printing conductive paste.

8) The antenna element portion may be formed from sintered conductive powder.

9) One end of the approximately helical-shaped portion is joined with one end of the approximately meander-shaped portion so that the approximately helical-shaped portion and the approximately meander-shaped portion are disposed on the rod as a cascaded structure.

10) A position close to a tip of the core rod may have a connecting point, at which one end of the approximately helical-shaped portion and the approximately meander-shaped portion are connected, and at which these two portions seem to be "folded over". The approximately meander-shaped portion is placed on the rod so as to be parallel to an axis of the approximately helical-shaped portion.

11) A position close to a tip of the core rod may have a connecting point, at which one end of the approximately helical-shaped portion and the approximately meander-shaped portion are connected, and at which these two portions seem to be "folded over". At least a part of each second conductor of the approximately meander-shaped portion is circularly arc-shaped, having a diameter almost equal to that of the approximately helical-shaped portion. At the same time, an arrangement of the approximately meander-shaped portion is maintained to be concentric with the approximately helical-shaped portion, but having no contact with it.

12) The feed portion may be formed with the antenna element portion as one piece.

13) A dielectric material radome, which partially covers the antenna element portion and the feed portion, may be removed.

According to the present invention, each electrical length and its ratio of the approximately helical-shaped portion and the approximately meander-shaped portion can be defined easily. As compared with a conventional antenna, the antenna of the present invention can easily provide desired multi-ranged frequency bands with optimal impedance characteristics. This allows the antenna to be compact and cost-reduced, having advantages of wide frequency range, high antenna gain, and high reliability.

The present invention covers not only a radio communication apparatus equipped with the antenna, but also a radio communication apparatus equipped with two antennas for diverse communications.

DESCRIPTION OF THE PREFERRED EMBODIMENTS

The preferred embodiments of the present invention are described hereinafter with reference to the accompanying drawings, FIG. 1 through FIG. 11.

First Preferred Embodiment

Figure 1:
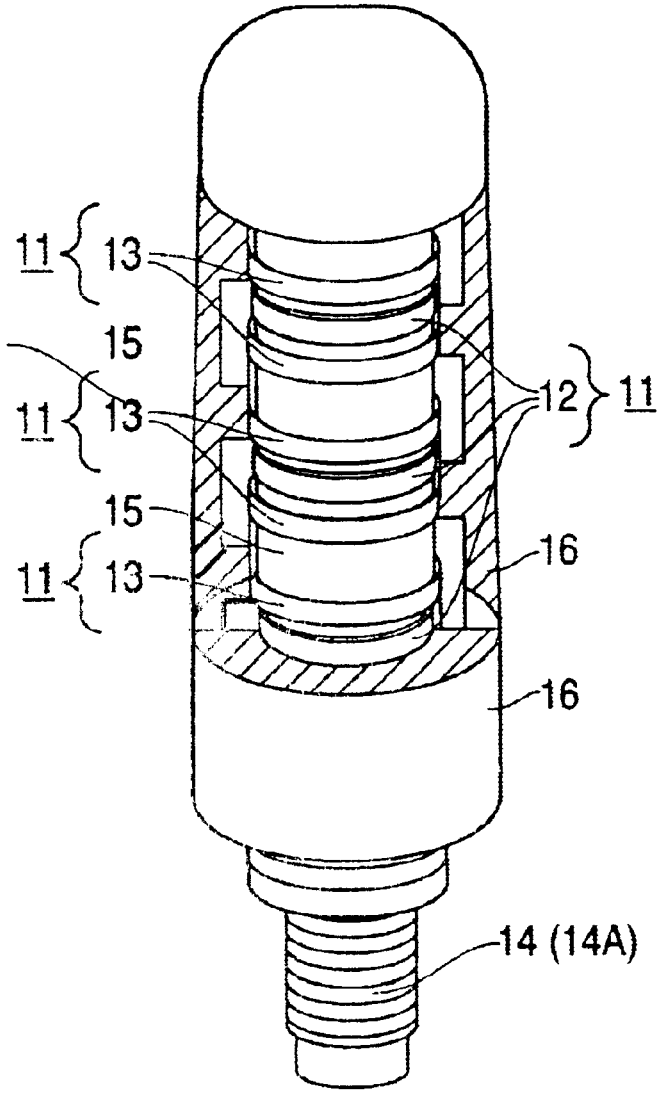
FIG. 1 is a perspective view, taken partly in cross-section, of an antenna in accordance with a first preferred embodiment of the present invention.
Figure 2:
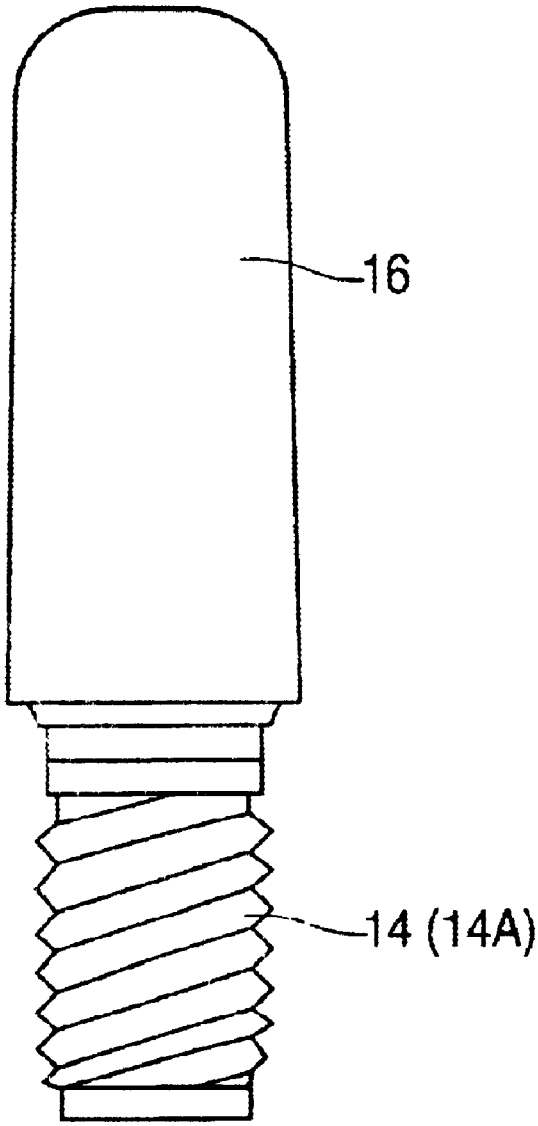
FIG. 2 is a front view of the antenna in accordance with the first preferred embodiment.
Figure 3:
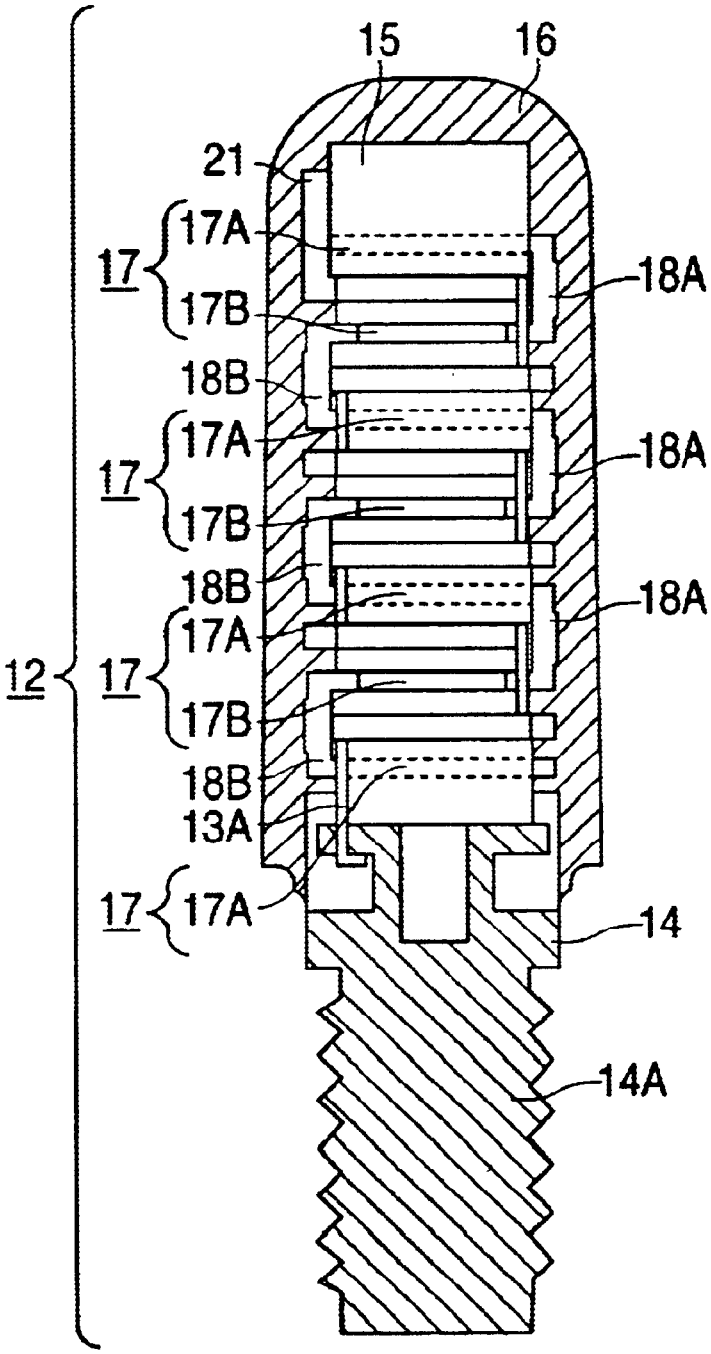
FIG. 3 is a cross-sectional view seen from a front of the antenna in accordance with the first preferred embodiment.
Figure 4:
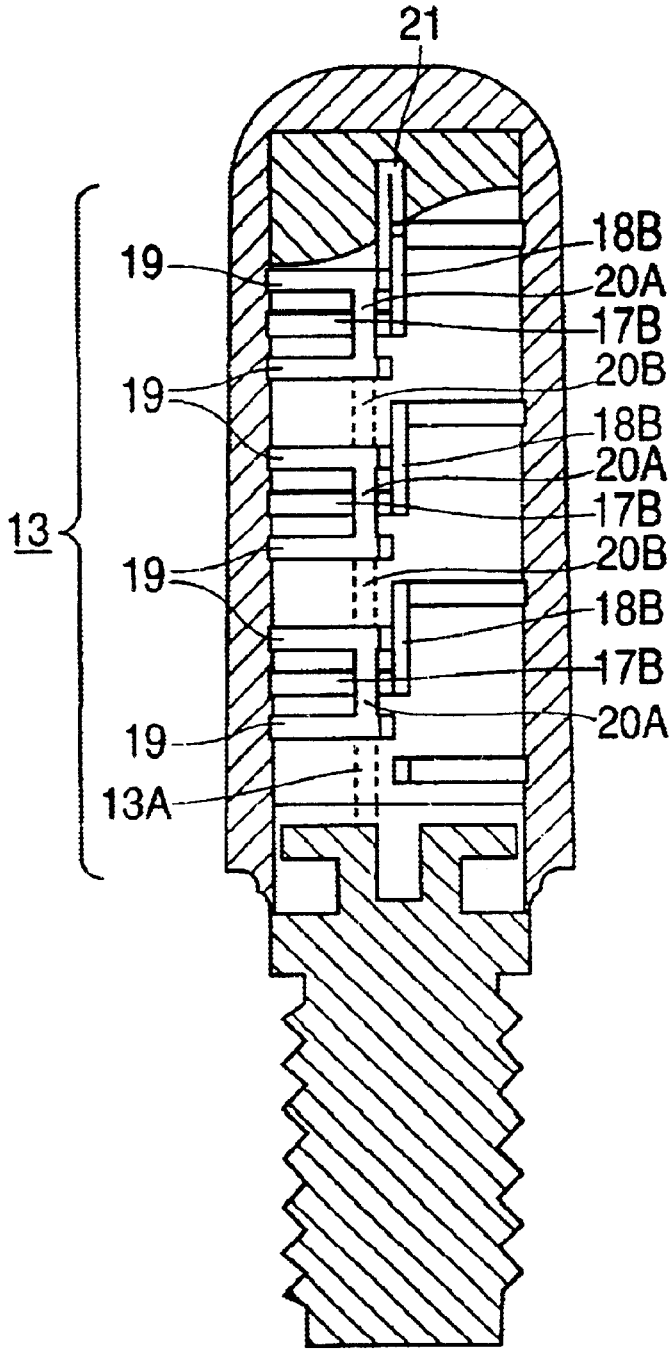
FIG. 4 is a cross-sectional view seen from a right hand side of the antenna in accordance with the first preferred embodiment.
Figure 5:
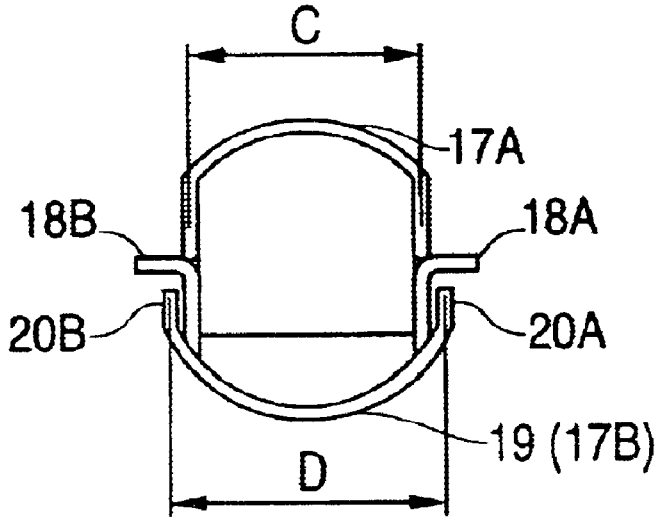
FIG. 5 is a top view of an antenna element of the antenna in accordance with the first preferred embodiment.

FIG. 1 is a perspective view, taken partly in cross-section, of an antenna in accordance with a first preferred embodiment of the present invention. FIG. 2 shows an appearance of the antenna. FIGS. 3 and 4 show cross-sectional views seen from a front side and from a right-hand side of the antenna, respectively. Antenna element 11 shown in FIG. 1 is formed through procedures below.

An approximately helical-shaped portion 12, is made by die cutting and press-processing a thin metal plate having superior conductivity, such as a copper alloy plate. Similarly, an approximately meander-shaped portion 13, is also made by die cutting and press-processing a thin metal plate having superior conductivity, such as a copper alloy plate. Approximately helical-shaped portion 12 and approximately meander-shaped portion 13 are connected to each other at top ends, forming antenna element 11. Both portions 12 and 13 look like being folded over at a connecting point. Feed metal fitting 14 is connected to bottom end 13A (see FIG. 3) of approximately meander-shaped portion 13 of antenna element 11. Fitting 14 has, on its periphery, mounting screw portion 14A (see FIG. 2) that is to be screwed into a radio communication apparatus using the antenna.

In FIGS. 1 and 2, core rod 15 is made of olefin elastomer resin having a dielectric constant of about 2.2. Rod 15 holds approximately helical-shaped portion 12 and approximately meander-shaped portion 13 of antenna element 11 so as to be concentric with an axis of the rod, providing a non-contacting state between both portions. Rod 15 also maintains an intimate contact with fitting 14. Radome 16 is made of olefin elastomer resin having a dielectric constant of about 2.5. Radome 16 shields a periphery of antenna element 11, with a portion adjacent to mounting screw section 14A of fitting 14 being exposed.

A shape of antenna element 11 is shown in detail in FIGS. 3 and 4. Half-round and thin belt-shaped first conductor 17 has a diameter generally the same as that of the core rod 15. A plurality of first conductors 17 are disposed in parallel, from a position close to a tip of rod 15, in its axial direction at predetermined spaced intervals on front-round surface 17B and rear-round surface 17A of the core rod. Rows of conductors 17 are placed on core rod 15 so as to form a staggered arrangement between the front-round surface and the rear-round surface of the rod. Short and thin belt-shaped conductors 18A and 18B join adjacent ends of the first conductors, forming approximately helical-shaped portion 12. Similarly, a plurality of thin belt-shaped second conductors 19 are placed in parallel on a round surface of core rod 15, from a position adjacent the tip of the rod, in its axial direction at predetermined spaced intervals. As in the case of the a joint for the first conductor, short and thin belt-shaped conductors 20A and 20B join adjacent ends of the second conductors, forming approximately meander-shaped portion 13. As shown in FIG. 3 and FIG. 4, one end of approximately helical-shaped portion 12 is in an open circuited state, and another end is connected with one end of approximately meander-shaped portion 13 at joint 21 adjacent to the tip of core rod 15. Feed metal fitting 14 is connected, as shown in FIG. 3, to another end 13A of portion 13.

In FIG. 4, each of joint portions 18A, 18B, and 20A, 20B is properly located so that second conductor 19 of approximately meander-shaped portion 13 is retained between each first conductor 17B (indicated by solid lines in FIG. 3), remaining in a non-contacting state. In this way, approximately helical-shaped portion 12 and approximately meander-shaped portion 13 are formed. In this case, when antenna element 11 is formed from a combination of approximately helical-shaped portion 12 and approximately meander-shaped portion 13, joint portions 20A and 20B have no contact with first conductors 17. To realize this, as shown in the top view of the antenna element of FIG. 5, diameter C is a bit smaller than diameter D of second conductor 19 shaped to be generally half-round. In addition, joint portions 20A, 20B are slightly spaced from joint portions 18A, 18B, respectively.

The antenna of the embodiment is thus configured. Now will be described how the antenna works.

The antenna shown in FIG. 1 is screwed into a predetermined position of a radio communication apparatus (not shown) by screw portion 14A formed around feed metal fitting 14. Radio-frequency signals corresponding to waves transmitted/received through the antenna are communicated, via the fitting 14, between a radio-frequency circuit (not shown) of the apparatus and the antenna. An electrical length of antenna element 11 is determined, through electrical coupling, at an optimal value having good VSWR characteristics in first and second frequency bands.

The electrical length is defined by many factors—an inductance of approximately helical-shaped portion 12 and approximately meander-shaped portion 13, a stray capacitance between a plurality of the first conductors, a stray capacitance between a plurality of the second conductors, a stray capacitance between a plurality of the first conductors and a plurality of the second conductors, a dielectric constant of core rod 15, and a dielectric constant of radome 16. The electrical length is determined to about $3\lambda/8$ through $5\lambda/8$, which allows the antenna to have good impedance characteristics in the first frequency band. Similarly, the electrical length is determined to about $\lambda/2$ to provide the antenna with good impedance characteristics in the second frequency band. The two settings of the electrical length allow the antenna element 11 to effectively transmit/receive waves in two frequency ranges. A reason why single antenna element 11 can handle waves in two frequency ranges will be described below.

Like the antenna element of the embodiment, the prior art antenna element can change a diameter or pitch of a helical portion. In the prior art, however, a portion corresponding to approximately meander-shaped portion 13 of the embodiment can be changed only in its length and thickness due to a shape of a linear conductor. On the other hand, according to the embodiment, various parameters—length, width, number, and pitch of the second conductor of approximately meander-shaped portion 13—can be changed. As a result, each stray capacitance and inductance mentioned above can be varied with more flexibility. Therefore, it becomes possible to obtain an electrical length appropriate for two frequency bands by changing these parameters.

Figure 6:
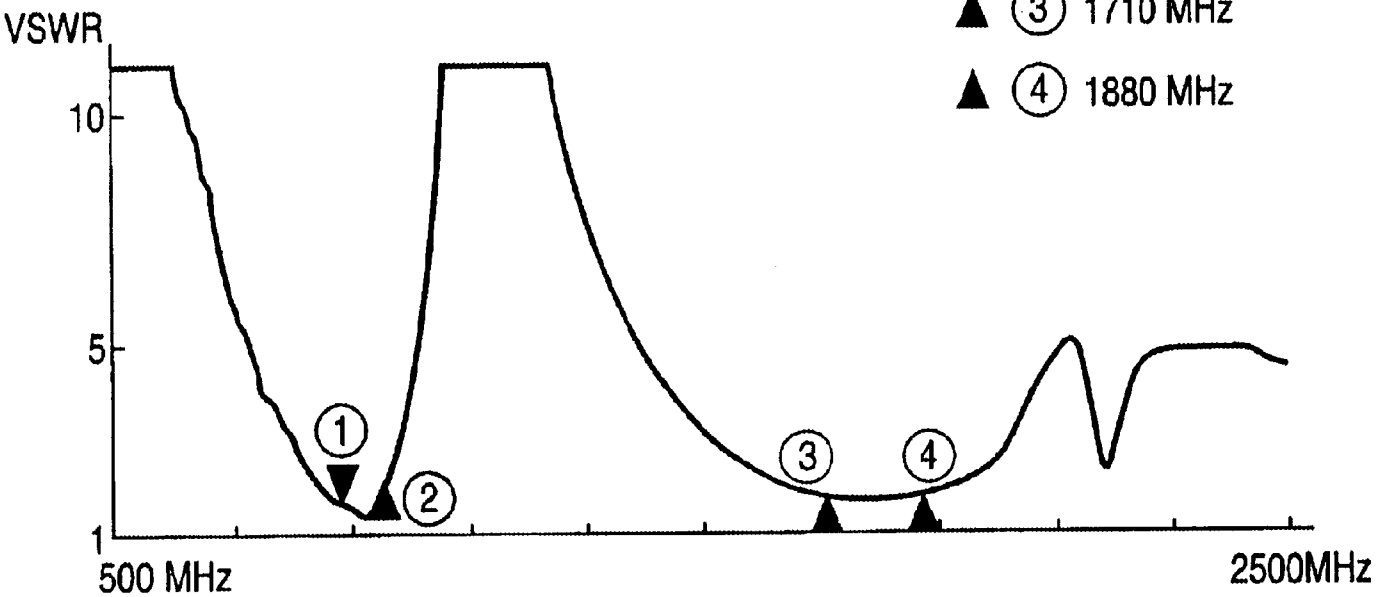
FIG. 6 is a graph indicating frequency characteristics of voltage standing wave ratio (VSWR) for the antenna in accordance with the first preferred embodiment.

As described above, according to the embodiment, the electrical length is varied, with help of electrical coupling, by changing a pitch or the diameter of second conductor 19 so that the antenna works with optimal impedance characteristics in the second frequency band. Furthermore, changing a pitch or the diameter of first conductor 17 provides another electrical length by which the antenna works with good impedance characteristics in the first frequency band, with the impedance characteristics in the second frequency band. Thus, the electrical length can be separately determined with no interference between each frequency band and respective VSWR characteristic. As a result, desired impedance characteristics can be obtained, as shown in FIG. 6—a graph that indicates frequency characteristics of VSWR for the antenna, in a frequency band not only for GSM ranging from 890 to 960 MHz corresponding to the first frequency band (between ▼1 and ▼2), but also for PCN ranging 1,710 to 1,880 MHz corresponding to the second frequency band (between ▼3 and ▼4). Thus, realized is an antenna having wide frequency range and high antenna gain.

In addition, electrical length can be effectively extended by utilizing stray capacitance between a plurality of first conductors, stray capacitance between a plurality of second conductors, stray capacitance between a plurality of first conductors and a plurality of second conductors, and dielectric constants of the core rod and the radome. An electrical length can be actually obtained by an antenna element that is mechanically shorter in length than that usually required for the electrical length. This fact contributes to realize a compact and lightweight antenna with higher reliability.

Furthermore, according to the embodiment, antenna element 11 is made of a thin metal plate with superior conductivity through die-cutting and press processes. Such formation minimizes non-uniformity and deformation in a pitch of first conductors 17 and second conductors 19, thereby realizing simple assembly with low cost.

Good impedance characteristics in desired frequency bands may be effectively obtained by: cutting a portion of first conductors 17 or an intentionally disposed adjusting extension of the conductors, by properly defining a number of second conductors 19, and by changing a dielectric constant of dielectric materials forming core rod 15 or radome 16. Strength of electrical coupling between helical-shaped portion 12 and meander-shaped portion 13 can be changed by providing second conductor 19 with a predetermined slant with respect to first conductor 17 on a front half-round surface of core rod 15. This allows impedance characteristics to be easily and widely controlled. Joint portions 18A, 18B, 20A, and 20B are not necessarily shaped the same as ones shown in FIGS. 3 and 4—for example, V-shaped sharp joint portions can provide as good a result as structure described above. Antenna element 11 of the embodiment is made of a thin metal plate with superior conductivity through die-cutting and press processes. Other than that, the antenna element can be formed of a metal with superior conductivity through mechanical, electrochemical, or pressurized and heated forming/processing to obtain similar effects mentioned above. The antenna element could be formed of: a metal wire with superior conductivity, such as a copper alloy or a Cu, Ni-plated metal; an etching-processed conductor; a press-processed flexible wiring board; printed conductive paste or sintered conductive powder.

Second Preferred Embodiment

Figure 7:
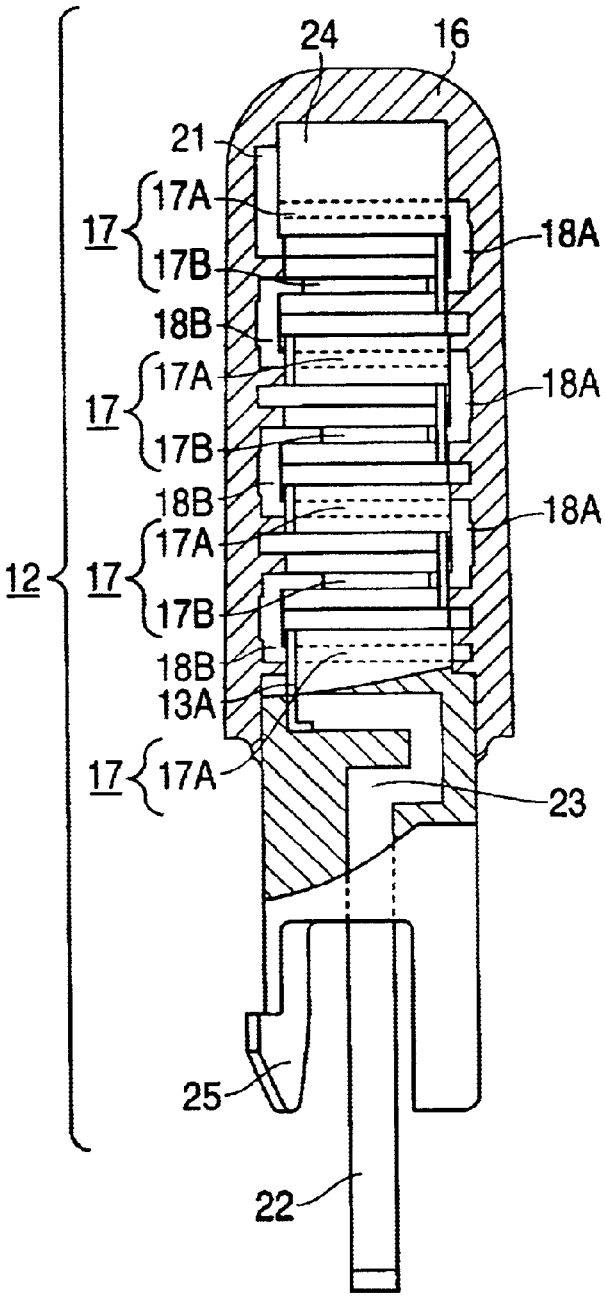
FIG. 7 is a cross-sectional view seen from a front of an antenna in accordance with a second preferred embodiment.
Figure 8:
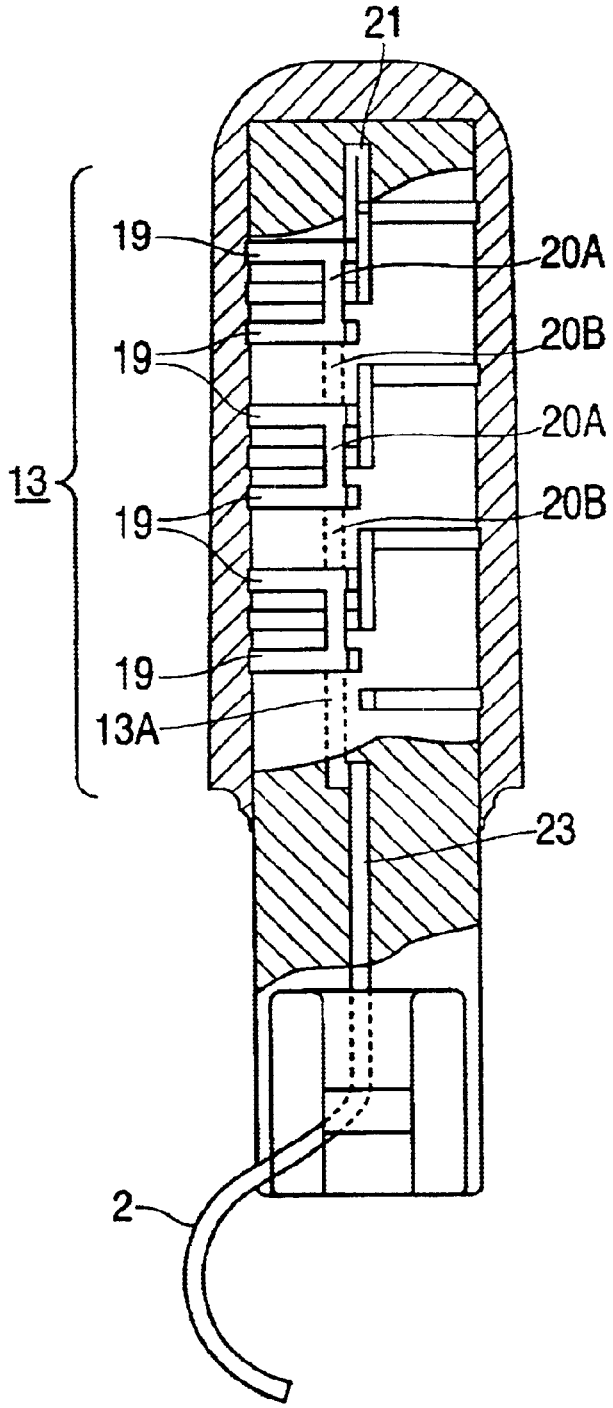
FIG. 8 is a cross-sectional view seen from a right hand side of the antenna in accordance with the second preferred embodiment.

FIGS. 7 and 8 are cross-sectional views seen from a front and from a right hand side of an antenna, respectively, in accordance with a second preferred embodiment. In the figures, like parts are identified by the same reference numerals as in the first embodiment and a detailed explanation will be omitted. As shown in FIGS. 7 and 8, approximately helical-shaped portion 12 and approximately meander-shaped portion 13 of antenna element 11 are formed from as with the first embodiment (see FIG. 1), a thin metal plate with superior conductivity, including a copper alloy plate, through die-cutting and press processing. Portion 12 and portion 13 are connected to each other at joint portion 21 adjacent to a top end of core rod 24. In this embodiment, as shown in FIG. 7, antenna element 11 is of one-piece construction with feed terminal 23 linked to bottom end 13A of approximately meander-shaped portion 13. Feed terminal 23 contains elastic metal-plate contact 22, which is firmly connected to an input/output circuit pattern of a radio-frequency circuit in a radio communication apparatus when the antenna is fixed to the apparatus (see FIG. 8). Terminal 23, as shown in FIG. 7, has intimate contact with core rod 24, which is an ABS resin-made rod having a dielectric constant of about 2.3. The rod 24 includes flexible pawl 25 at a perimeter of a bottom end of the rod. Pawl 25 is used for snap fitting the antenna into the radio communication apparatus. Radome 16 shields a periphery of antenna element 11, with a lowermost part of rod 24 and contact 22 being exposed.

According to this embodiment, in addition to advantages associated with the first embodiment, antenna element 11 and feed terminal 23 are formed into one piece. The integrated structure contributes to a reduced number of parts, thereby realizing a cost-reduced antenna.

Third Preferred Embodiment

Figure 9:
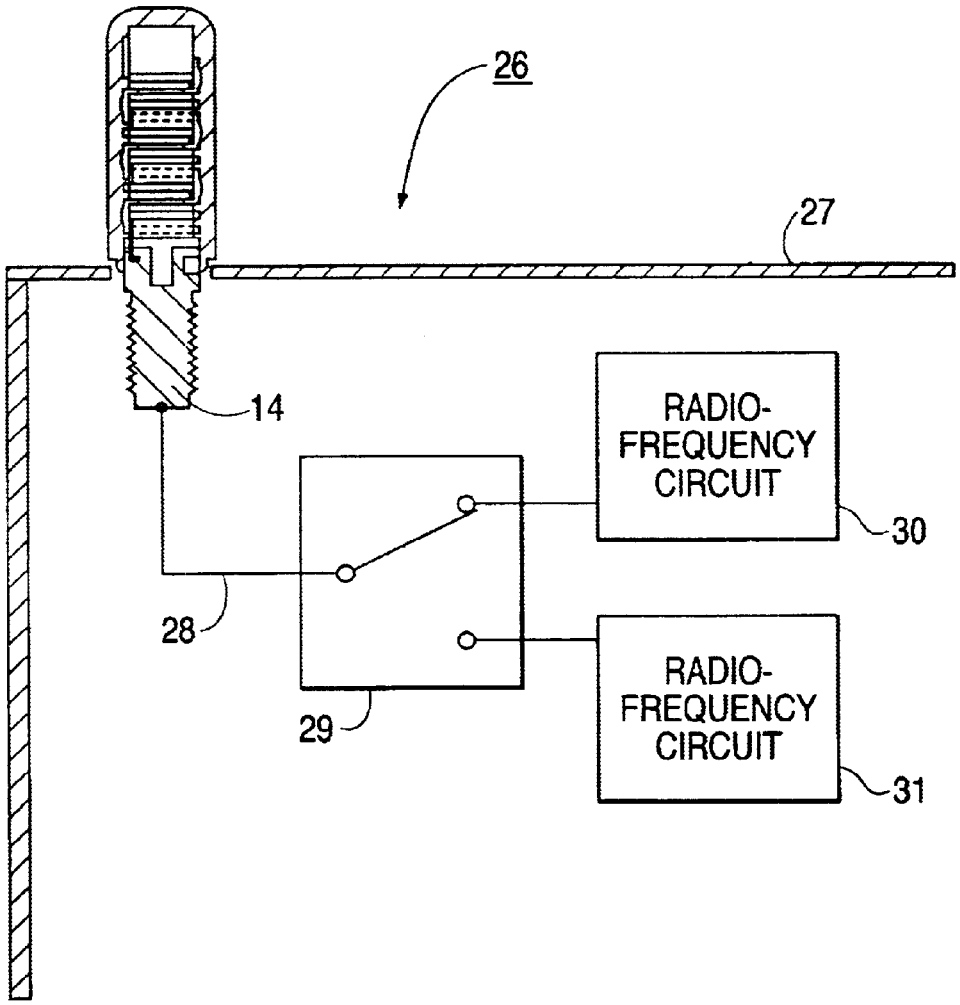
FIG. 9 is a circuit diagram of a radio communication apparatus, equipped with the antenna of the invention, of a third preferred embodiment.

FIG. 9 is a circuit diagram of a radio communication apparatus, equipped with an antenna of a third preferred embodiment. For the same construction as that described in FIG. 1 to FIG. 4, like parts are identified by the same reference numerals and a detailed explanation will be omitted. The radio communication apparatus is, as shown in FIG. 9, designated by numeral 26. An antenna (see FIGS. 1 and 2) is fixed to insulating resin-made housing 27 of radio communication apparatus 26. In apparatus 26, feeder 28 connects metal fitting 14 of the antenna to switch 29, through which fitting 14 is connected to radio-frequency circuit 30 for a first frequency band and to radio-frequency circuit 31 for a second frequency band.

According to this embodiment, the antenna can be easily attached to apparatus 26. In addition, the antenna has impedance characteristics suitable for desired multi-ranged frequency bands, which does away with a need to add a complicated impedance-matching circuit to the radio-frequency circuit in apparatus 26. This fact realizes a low-cost antenna.

Fourth Preferred Embodiment

Figure 10:
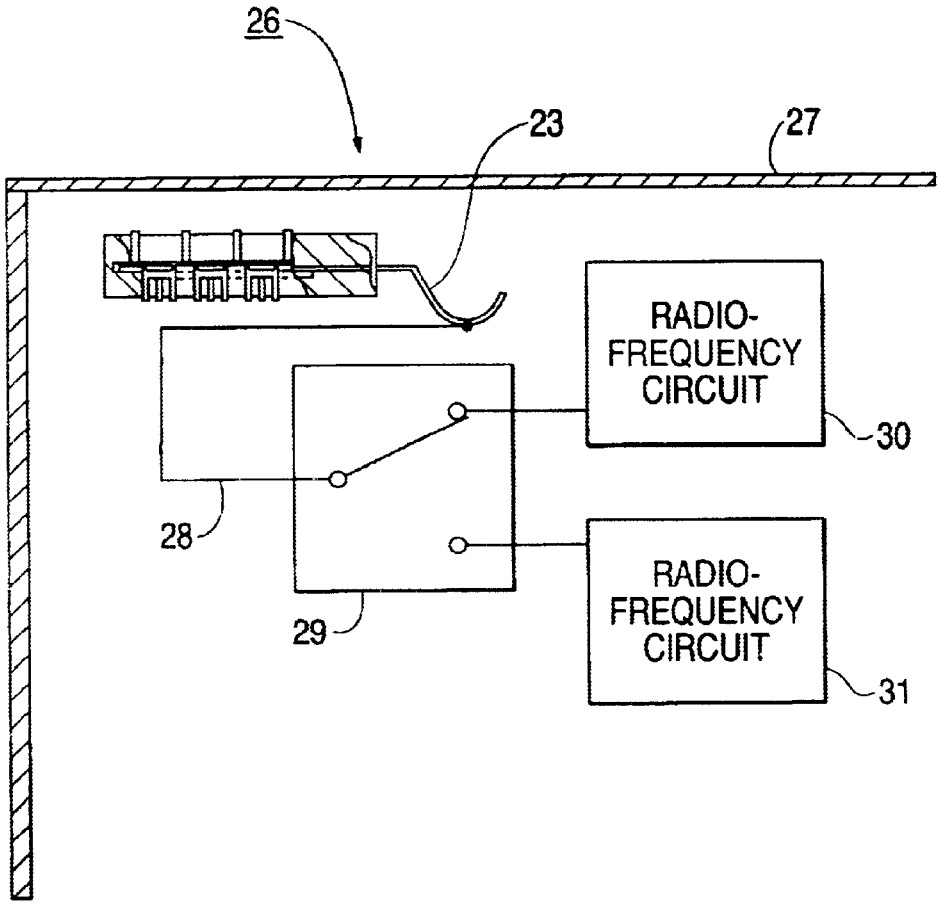
FIG. 10 is a circuit diagram of a radio communication apparatus, equipped with the antenna of the invention, of a fourth preferred embodiment.

FIG. 10 is a circuit diagram of a radio communication apparatus, equipped with an antenna, of a fourth preferred embodiment. For the same construction as that shown in FIG. 7 and FIG. 8, like parts are identified by the same reference numerals and a detailed explanation will be omitted. The antenna—the one shown in FIG. 7, with radome 16 removed—is fixed onto a circuit board (not shown) in housing 27 of radio communication apparatus 26, as shown in FIG. 10. In apparatus 26, feeder 28 connects feed terminal 23 of the antenna to switch 29, through which the antenna is connected to radio-frequency circuit 30 for a first frequency band and to radio-frequency circuit 31 for a second frequency band.

According to this embodiment, in addition to advantages associated with structure in the first through third embodiments, the antenna built into the radio communication apparatus can be protected from damage when apparatus 26 is accidentally dropped or given physical shock. It is possible to provide not only smaller-sized apparatus 26, but also easy installation of the antenna to the apparatus. As a result, a manufacturing cost of apparatus 26 can be substantially reduced.

Fifth Preferred Embodiment

Figure 11:
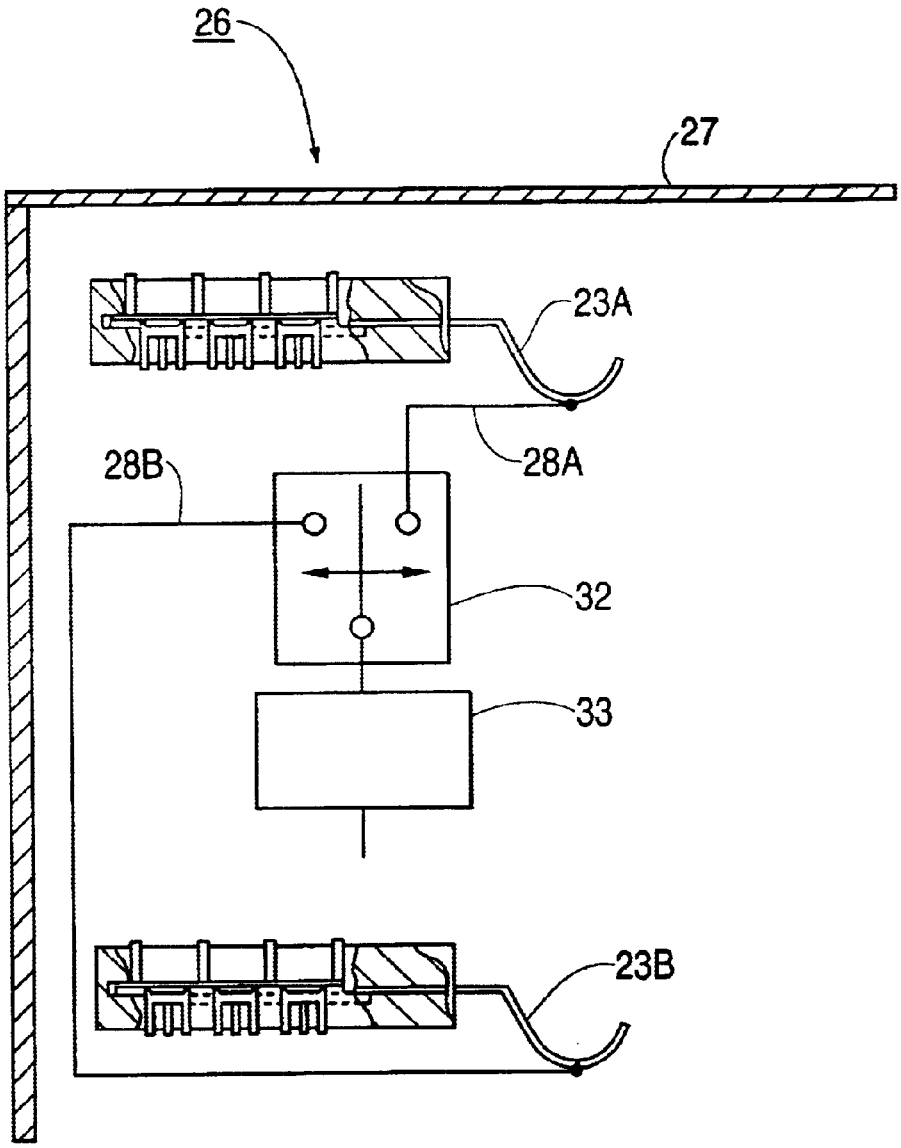
FIG. 11 is a circuit diagram of a radio communication apparatus, equipped with antennas of the invention, of a fifth preferred embodiment.
Figure 12:
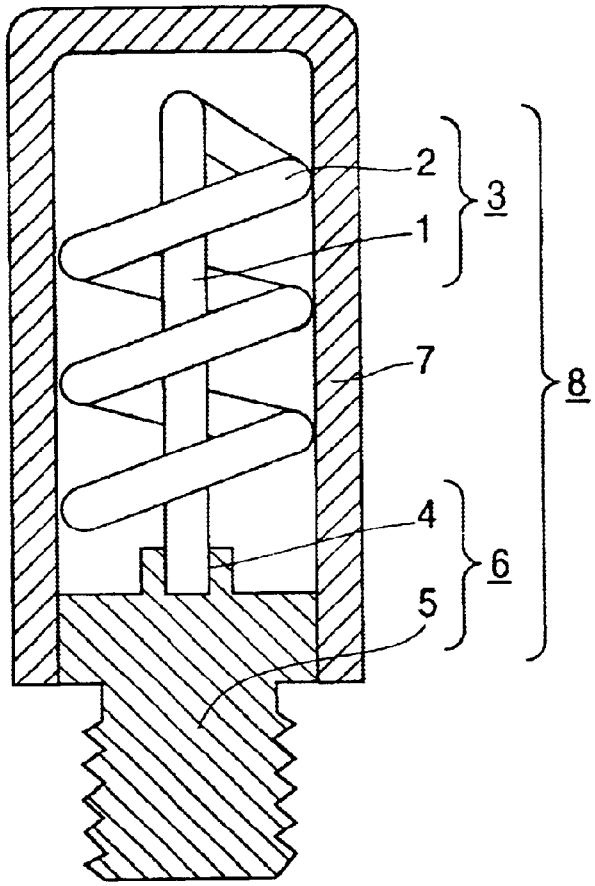
FIG. 12 (PRIOR ART)
FIG. 12 is a cross-sectional view indicating an essential part of a prior art antenna.
Figure 13:
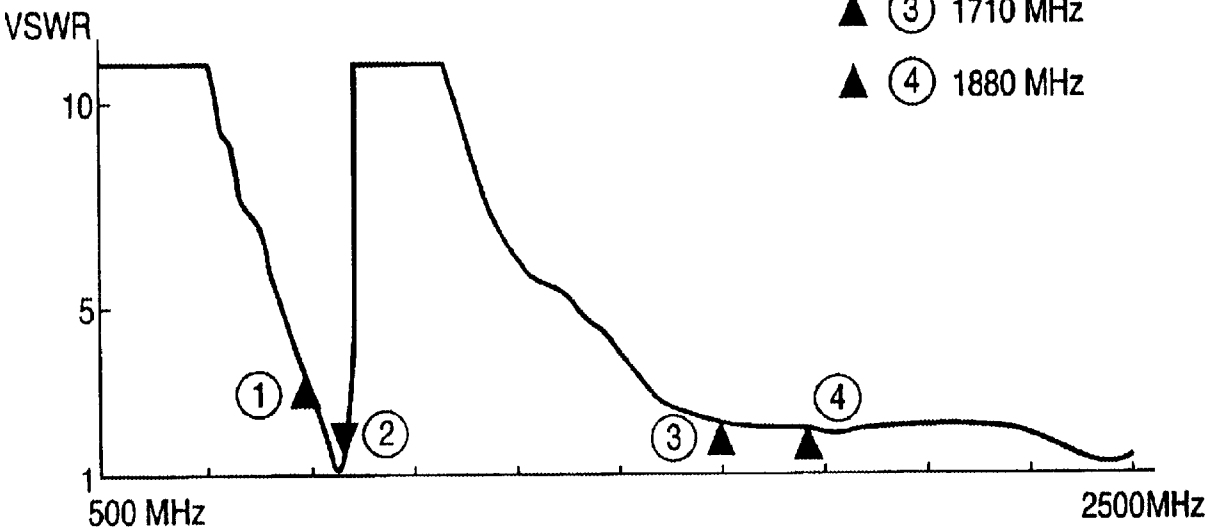
FIG. 13 (PRIOR ART)
FIG. 13 shows a graph indicating frequency characteristics of VSWR for the prior-art antenna.
Figure 14:
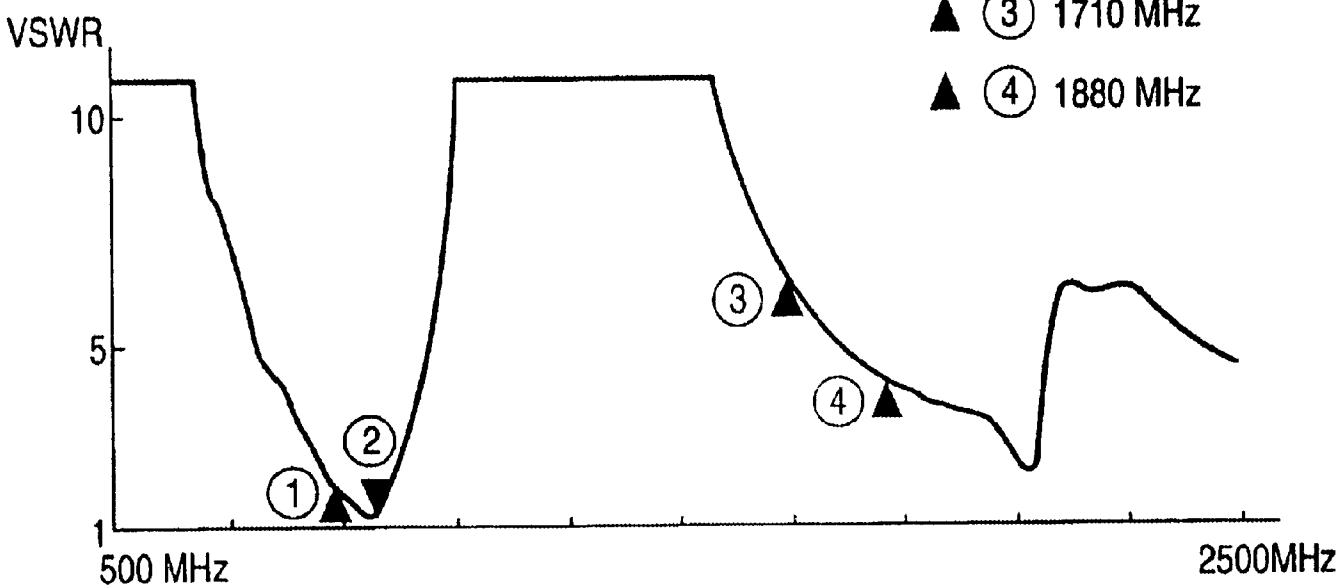
FIG. 14 (PRIOR ART)
FIG. 14 shows another example of a graph indicating frequency characteristics of VSWR for the prior art antenna.

FIG. 11 is a circuit diagram of a radio communication apparatus, equipped with an antenna, of a fifth preferred embodiment. For the same construction as that shown in FIGS. 7, 8 and 10, like parts are identified by the same reference numerals and a detailed explanation will be omitted. A first antenna and a second antenna—both are the same as the antenna shown in FIG. 7, with radome 16 removed—are disposed, as shown in FIG. 11, at upper and lower portions of a circuit board (not shown) in housing 27 of apparatus 26, respectively. Feeders 28A, 28B connect feed terminals 23A, 23B of the first and the second antennas to switch 32, respectively. The switch 32 is connected to radio-frequency circuitry 33. A circuit following circuitry 33 compares a receiving signal power level of the first antenna with that of the second antenna, by which circuitry 33 is automatically switched by switch 32 to the antenna having the greater receiving signal power. It thus becomes possible to perform diverse communication.

According to this embodiment, in addition to advantages associated with the fourth preferred embodiment, multiple use of antennas with impedance characteristics equivalent to each other in a desired frequency band can eliminate variations in impedance characteristics. This provides not only diverse communication system in a radio communication apparatus with high antenna gain and reliability, but also a cost-reduced radio communication apparatus due to simple installation of the antennas to the apparatus.

INDUSTRIAL APPLICABILITY

As described above, an antenna including an antenna element formed of a combination of an approximately helical-shaped portion and an approximately meander-shaped portion can easily adjust electric length for each of these portions. It is therefore possible to obtain good impedance characteristics in desired multi-ranged frequency bands, while realizing a smaller and cheaper antenna having a wide frequency range, high antenna gain and reliability. Using such an antenna allows installation of the antenna to a radio communication apparatus to be simple. Additionally, the antenna has good impedance characteristics for desired multi-ranged frequency bands, which does away with a need to add a complicated impedance-matching circuit to a radio-frequency circuit, thereby realizing a low-cost antenna.

What is claimed is:

1. An antenna for transmitting/receiving waves in a plurality of frequency bands, comprising:

a conductive antenna element portion;

a feed portion for establishing electrical connections between said conductive antenna element portion and a radio-frequency circuit of a radio communication apparatus; and a dielectric core rod mechanically supporting said conductive antenna element portion, wherein said conductive antenna element portion includes (i) an approximately helical-shaped portion concentric with said dielectric core rod, said approximately helical-shaped portion comprising (a) half round and thin belt-shaped first conductors having a diameter that is generally equal to a diameter of said dielectric core rod, said half-round and thin belt-shaped first conductors being arranged, in an axial direction of said dielectric core rod from near an end of said dielectric core rod, on a front round surface and a rear round surface of said dielectric core rod, said half-round and thin belt-shaped first conductors on said front round surface being spaced from one another along the axial direction of said core rod by a predetermined interval and said half-round and thin belt-shaped first conductors on said rear round surface being spaced from one another along the axial direction of said core rod by a predetermined interval, and said half-round and thin belt-shaped first conductors being parallel with one another, such that along the axial direction of said core rod said half-round and thin belt-shaped first conductors on said front round surface are staggered relative to said half-round and thin belt-shaped first conductors on said rear round surface, and (b) short and thin belt-shaped conductors interconnecting free ends of said half-round and thin belt-shaped first conductors on said front round surface with adjacent free ends of said half-round and thin belt-shaped first conductors on said rear round surface, respectively, and (ii) an approximately meander-shaped portion adjacent said approximately helical-shaped portion, said approximately meander-shaped portion comprising (a) parallel thin belt-shaped second conductors, and (b) short thin belt-shaped conductors interconnecting adjacent free ends of said parallel thin belt-shaped second conductors, respectively.

2. The antenna according to claim 1, wherein said half-round and thin belt-shaped first conductors and said thin belt-shaped second conductors are provided by die-cutting a thin conductive metal plate.

3. The antenna according to claim 1, wherein said conductive antenna element portion is formed from a pressed copper or copper alloy wire, or another conductive metal provided by performing an electrolytic plating process.

4. The antenna according to claim 1, wherein said conductive antenna element portion is formed from a pressed thin conductive plate having a predetermined pattern that is provided by performing an etching process.

5. The antenna according to claim 1, wherein said conductive antenna element portion is formed from a pressed flexible wiring board having a predetermined pattern thereon.

6. The antenna according to claim 1, wherein said conductive antenna element portion is formed by printing conductive paste.

7. The antenna according to claim 1, wherein said conductive antenna element portion is formed from sintered conductive powder.

8. The antenna according to claim 1, wherein one end of said approximately helical-shaped portion is joined to one end of said approximately meander-shaped portion such said approximately helical-shaped portion and said approximately meander-shaped portion are disposed on said dielectric core rod as a cascaded structure.

9. The antenna according to claim 1, wherein said approximately helical-shaped portion is connected to said approximately meander-shaped portion near the end of said dielectric core rod by folding one end of said approximately meander-shaped portion, and said approximately meander-shaped portion is parallel to an axis of said approximately helical-shaped portion.

10. The antenna according to claim 1, wherein said parallel thin belt-shaped second conductors are arc-shaped and have a diameter that is substantially equal to a diameter of said approximately helical-shaped portion, said approximately helical-shaped portion is connected to said approximately meander-shaped portion near the end of said dielectric core rod by folding one end of said approximately meander-shaped portion, and said approximately meander-shaped portion is concentric with and spaced from said approximately helical-shaped portion.

11. The antenna according to claim 1, wherein said feed portion and said conductive antenna element portion are formed as one piece.

12. The antenna according to claim 1, further comprising:

a dielectric radome partially covering said conductive antenna element portion and said feed portion.

13. The antenna according to claim 12, wherein a dielectric constant of said dielectric core rod is different than a dielectric constant of said dielectric radome.

14. The antenna according to claim 12, wherein said half-round and thin belt-shaped first conductors and said thin belt-shaped second conductors are provided by die-cutting a thin conductive metal plate.

15. The antenna according to claim 12, wherein said conductive antenna element portion is formed from a pressed copper or copper alloy wire, or another conductive metal provided by performing an electrolytic plating process.

16. The antenna according to claim 12, wherein said conductive antenna element portion is formed from a pressed thin conductive plate having a predetermined pattern that is provided by performing an etching process.

17. The antenna according to claim 12, wherein said conductive antenna element portion is formed from a pressed flexible wiring board having a predetermined pattern thereon.

18. The antenna according to claim 12, wherein said conductive antenna element portion is formed by printing conductive paste.

19. The antenna according to claim 12, wherein said conductive antenna element portion is formed from sintered conductive powder.

20. The antenna according to claim 12, wherein one end of said approximately helical-shaped portion is joined to one end of said approximately meander-shaped portion such said approximately helical-shaped portion and said approximately meander-shaped portion are disposed on said dielectric core rod as a cascaded structure.

21. The antenna according to claim 12, wherein said approximately helical-shaped portion is connected to said approximately meander-shaped portion near the end of said dielectric core rod by folding one end of said approximately meander-shaped portion, and said approximately meander-shaped portion is parallel to an axis of said approximately helical-shaped portion.

22. The antenna according to claim 12, wherein said parallel thin belt-shaped second conductors are arc-shaped and have a diameter that is substantially equal to a diameter of said approximately helical-shaped portion, said approximately helical-shaped portion is connected to said approximately meander-shaped portion near the end of said dielectric core rod by folding one end of said approximately meander-shaped portion, and said approximately meander-shaped portion is concentric with and spaced from said approximately helical-shaped portion.

23. The antenna according to claim 12, wherein said feed portion and said conductive element portion are formed as one piece.

24. A radio communication apparatus for diverse communication, comprising:

a first antenna for transmitting/receiving waves in a plurality of frequency bands, said first antenna including (i) a conductive antenna element portion, (ii) a feed portion for establishing electrical connections between said conductive antenna element portion and a radio-frequency circuit of the radio communication apparatus, (iii) a dielectric core rod mechanically supporting said conductive antenna element portion, and (iv) a dielectric radome partially covering said conductive antenna element portion and said feed portion, wherein said conductive antenna element portion includes (a) an approximately helical-shaped portion concentric with said dielectric core rod, and (b) an approximately meander-shaped portion;

a second antenna for transmitting/receiving waves in a plurality of frequency bands, said second antenna including (i) a conductive antenna element portion, (ii) a feed portion for establishing electrical connections between said conductive antenna element portion and a radio-frequency circuit of the radio communication apparatus, (iii) a dielectric core rod mechanically supporting said conductive antenna element portion, and (iv) a dielectric radome partially covering said conductive antenna element portion and said feed portion, wherein said conductive antenna element portion includes (a) an approximately helical-shaped portion concentric with said dielectric core rod, and (b) an approximately meander-shaped portion; and a switch for selecting one of said first conductive antenna element portion and said second conductive antenna element portion so as to perform diverse communication.

25. An antenna for transmitting/receiving waves in a plurality of frequency bands, comprising:

a conductive antenna element portion having a resonance frequency in each of the plurality of frequency bands;

a feed portion for establishing electrical connections between said conductive antenna element portion and a radio-frequency circuit of a radio communication apparatus; and a dielectric core rod mechanically supporting said conductive antenna element portion, wherein said conductive antenna element portion includes (i) a first conductor having an approximately helical shape and disposed concentrically with said dielectric core rod on a side surface of said dielectric core rod, and (ii) a second conductor, having an approximately meander shape, electromagnetically coupled with said first conductor so as to obtain desired antenna characteristics by adjusting a coupling coefficient between said first conductor and said second conductor, with one end of said first conductor being in contact with one end of said second conductor so as to form a single antenna element, another end of said first conductor being open, and another end of said second conductor being connected to said feed portion.

26. The antenna according to claim 25, wherein said feed portion is at a bottom of said dielectric core rod, and said one end of said first conductor is in contact with said one end of said second conductor near a top of said dielectric core rod.

27. The antenna according to claim 25, further comprising:

a dielectric radome partially covering said conductive antenna element portion and said feed portion.

28. The antenna according to claim 27, wherein said feed portion is at a bottom of said dielectric core rod, and said one end of said first conductor is in contact with said one end of said second conductor near a top of said dielectric core rod.

29. The antenna according to claim 28, wherein a dielectric constant of said dielectric core rod is different than a dielectric constant of said dielectric radome.

30. The antenna according to claim 27, wherein a dielectric constant of said dielectric core rod is different than a dielectric constant of said dielectric radome.

31. A radio communication apparatus capable of communication in a plurality of frequency bands, comprising:

an antenna for transmitting/receiving waves in a plurality of frequency bands, said antenna including (i) a conductive antenna element portion having a resonance frequency in each of the plurality of frequency bands, (ii) a feed portion for establishing electrical connections between said conductive antenna element portion and a radio-frequency circuit of the radio communication apparatus, (iii) a dielectric core rod mechanically supporting said conductive antenna element portion, and (iv) a dielectric radome partially covering said conductive antenna element portion and said feed portion, wherein said conductive antenna element portion includes (a) a first conductor having an approximately helical shape and disposed concentrically with said dielectric core rod on a side surface of said dielectric core rod, and (b) a second conductor, having an approximately meander shape, electromagnetically coupled with said first conductor so as to obtain desired antenna characteristics by adjusting a coupling coefficient between said first conductor and said second conductor, with one end of said first conductor being in contact with one end of said second conductor so as to form a single antenna element, another end of said first conductor being open, and another end of said second conductor being connected to said feed portion.

32. The radio communication apparatus according to claim 31, wherein said feed portion is at a bottom of said dielectric core rod, and said one end of said first conductor is in contact with said one end of said second conductor near a top of said dielectric core rod.

33. A radio communication apparatus capable of communication in a plurality of frequency bands, comprising:

an antenna for transmitting/receiving waves in a plurality of frequency bands, said antenna including (i) a conductive antenna element portion having a resonance frequency in each of the plurality of frequency bands, (ii) a feed portion for establishing electrical connections between said conductive antenna element portion and a radio-frequency circuit of a radio communication apparatus, and (iii) a dielectric core rod mechanically supporting said conductive antenna element portion, wherein said conductive antenna element portion includes (a) a first conductor having an approximately helical shape and disposed concentrically with said dielectric core rod on a side surface of said dielectric core rod, and (b) a second conductor, having an approximately meander shape, electromagnetically coupled with said first conductor so as to obtain desired antenna characteristics by adjusting a coupling coefficient between said first conductor and said second conductor, with one end of said first conductor being in contact with one end of said second conductor so as to form a single antenna element, another end of said first conductor being open, and another end of said second conductor being connected to said feed portion.

34. The radio communication apparatus according to claim 33, wherein feed portion is at a bottom of said dielectric core rod, and said one end of said first conductor is in contact with said one end of said second conductor near a top of said dielectric core rod.

* * * * *

UNITED STATES PATENT AND TRADEMARK OFFICE

CERTIFICATE OF CORRECTION

PATENT NO. : 6,661,391 B2
DATED : December 9, 2003
INVENTOR(S) : Masahiro Ohara et al.

It is certified that error appears in the above-identified patent and that said Letters Patent is hereby corrected as shown below:

Column 14,
Line 44, please replace "feed portion is" with -- said feed portion is --.

Signed and Sealed this

Twenty-fourth Day of August, 2004

JON W. DUDAS
*Director of the United States Patent and Trademark Office*